US007478739B2

(12) United States Patent
Foster

(10) Patent No.: US 7,478,739 B2
(45) Date of Patent: Jan. 20, 2009

(54) SNAP DOWN BAYONET CONNECTOR

(75) Inventor: Donald D. Foster, St. Charles, MO (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 333 days.

(21) Appl. No.: 11/374,916

(22) Filed: Mar. 14, 2006

(65) Prior Publication Data

US 2007/0215646 A1 Sep. 20, 2007

(51) Int. Cl.
*B67D 5/40* (2006.01)

(52) U.S. Cl. ..... 222/383.1; 222/340; 222/153.01; 222/153.09; 215/222; 215/224

(58) Field of Classification Search ..... 222/383.1, 222/340, 153.01, 153.09, 153.14; 239/337, 239/340, 333; 215/222, 224
See application file for complete search history.

(56) References Cited

U.S. PATENT DOCUMENTS

| | | | | | |
|---|---|---|---|---|---|
| 4,781,311 | A * | 11/1988 | Dunning et al. | ..... | 222/153.09 |
| 5,169,033 | A * | 12/1992 | Shay | ..... | 222/153.09 |
| 5,845,820 | A | 12/1998 | Foster | | |
| 6,032,814 | A * | 3/2000 | Foster | ..... | 215/332 |
| 2007/0290005 | A1 * | 12/2007 | Foster et al. | ..... | 222/383.1 |

* cited by examiner

*Primary Examiner*—Frederick C. Nicolas

(57) ABSTRACT

A connector cap of a trigger sprayer is integrally formed with the sprayer housing of the trigger sprayer. The connector cap has a flexible cylindrical sidewall of varying thicknesses that enables the cap to be flexed and snap fit on a bayonet-type connector of a bottle neck by pressing the cap downwardly onto the bottle neck. The different thicknesses of the sidewall allow portions of the sidewall to flex, while maintaining a smooth, cylindrical exterior surface appearance of the sidewall.

20 Claims, 3 Drawing Sheets

SNAP DOWN BAYONET CONNECTOR

BACKGROUND OF THE INVENTION (1) Field of the Invention

The present invention pertains to a connector for connecting a trigger sprayer to a bottle. In particular, the present invention pertains to a connector cap of a trigger sprayer that is integrally formed with the sprayer housing of the trigger sprayer. The connector cap has a flexible cylindrical sidewall of varying thicknesses that enables the cap to be flexed and snap fit on a bayonet-type connector of a bottle neck by pressing the cap downwardly onto the bottle neck.

(2) Description of the Related Art

Trigger sprayers are those types of sprayers that can be held in a single hand of the user and operated by the fingers of the user's hand to pump liquid from a bottle connected to the trigger sprayer. A trigger sprayer typically comprises a sprayer housing that contains a pump chamber, a liquid supply passage that communicates a liquid inlet opening on the sprayer housing with the pump chamber, and a liquid discharge passage that communicates the pump chamber with a liquid outlet opening on the sprayer housing.

A dip tube is connected to the sprayer housing liquid inlet opening. The dip tube is extended through the neck of the bottle connected to the trigger sprayer, and into the liquid in the bottle. The dip tube communicates the liquid through the liquid supply passage of the sprayer housing, with the pump chamber of the sprayer housing.

A nozzle assembly is connected to the sprayer housing at the liquid outlet opening. Various different types of nozzle assemblies are known. The typical nozzle assembly is adjustable to provide various different discharge patterns of the liquid dispensed from the trigger sprayer. For example, the liquid can be dispensed in a stream or spray pattern, or as a foam.

A manually manipulated trigger is mounted on the sprayer housing for pivoting movement by the fingers of the user's hand. The trigger is operatively connected to the pump of the trigger sprayer. Manual manipulation of the trigger operates the pump, which draws liquid from the bottle connected to the trigger sprayer and dispenses the liquid from the trigger sprayer.

Many trigger sprayers are attached to their bottles by an internally threaded cap. To firmly secure the trigger sprayer on the bottle neck, the cap is positioned on the bottle neck and rotated. Complementary screw threading provided on the interior of the cap and the exterior of the bottle neck securely attach the trigger sprayer to the bottle.

Many trigger sprayers are also provided with bayonet-type connectors. Bayonet-type connectors firmly attach the trigger sprayer on the bottle neck by rotating the trigger sprayer connector cap relative to the bottle neck. However, with a bayonet-type connector, it is not necessary to rotate the trigger sprayer connector cap a full rotation to attach the trigger sprayer to the bottle. Trigger sprayers with bayonet-type connectors can be attached to complementary bottle necks by rotating the trigger sprayer connector a fraction of one complete revolution relative to the bottle neck. These types of connectors are advantageously used where a trigger sprayer is attached to a bottle neck by a machine in an assembly line.

Both types of trigger sprayer connectors discussed above require that the connector cap of the trigger sprayer be rotated relative to the bottle neck in attaching the trigger sprayer to the bottle neck. Even the bayonet-type connector is required to be rotated relative to the bottle neck to attach the trigger sprayer to the bottle neck. These types of trigger sprayer connectors have two different movements to attach the connector on a bottle neck. The connector must be moved in a linear direction onto the bottle neck while also being rotated relative to the bottle neck.

SUMMARY OF THE INVENTION

The present invention overcomes disadvantages associated with prior art trigger sprayer connectors by providing a novel design for a trigger sprayer connector that can be securely attached to a bottle neck in one movement, without rotating the connector relative to the bottle neck.

The bottle neck to which the connector of the invention is attached is designed for a bayonet-type connection. The bottle neck has horizontally oriented ridges that are spatially arranged around the bottle neck exterior surface. The horizontally oriented ridges secure the trigger sprayer connector of the invention to the bottle neck. The bottle neck is also provided with a plurality of vertically oriented ridges that prevent relative rotation between the trigger sprayer connector of the invention and the bottle neck.

In the preferred embodiment of the invention, the trigger sprayer connector is formed integrally as one piece with the sprayer housing of the trigger sprayer. The connector has a cylindrical sidewall that is dimensioned to fit over the bottle neck. A plurality of lug assemblies are provided on the interior surface of the sidewall. The positioning of the lug assembly on the connector sidewall corresponds to the positioning of the horizontal ridges on the bottle neck. Each lug assembly is provided with at least a pair of spaced lugs that engage above and below a horizontal ridge of the bottle neck when attaching the connector to the bottle neck. A bottom lug of each pair is designed to cam over the horizontal ridge as the connector is pressed downwardly onto the bottle neck. As the lower lug passes over the horizontal ridge, the resilience of the connector cap sidewall snaps the lower lug inwardly beneath the horizontal ridge, securing the horizontal ridge between the pair of upper and lower lugs.

The novel design of the connector of the invention includes a modified sidewall that allows the sidewall to easily flex as the lower lug of each lug assembly passes over a horizontal ridge of the bottle neck. The cylindrical sidewall is provided with thin areas that alternate with thick areas around the circumference of the sidewall. The thin areas of the sidewall have a greater resilience than the thick areas, and allow the sidewall to flex as the connector is pressed downwardly over the bottle neck. To provide a secure attachment of the trigger sprayer connector to the bottle neck, the lug assemblies are provided on the thick areas of the sidewall.

The thin areas of the sidewall allow the thick areas of the sidewall with the lug assemblies to flex radially outwardly as the lower lug of each lug assembly passes over a horizontal ridge on the bottle neck. As the lower lug passes over the horizontal ridge, the resilience of the sidewall snaps the sidewall back to its original cylindrical configuration. This positions a lower lug of each lug assembly beneath a horizontal ridge on the bottle neck, and positions an upper lug of each lug assembly above a horizontal ridge on the bottle neck. This securely attaches the trigger sprayer to the bottle neck by simply pressing the trigger sprayer connector downwardly on the bottle neck, without rotating the connector relative to the bottle neck.

BRIEF DESCRIPTION OF THE DRAWINGS

Further features of the present invention are set forth in the detailed description of the preferred embodiment of the invention and in the drawing figures wherein.

DETAILED DESCRIPTION OF THE PREFERRED EMBODIMENT

Figure 1:
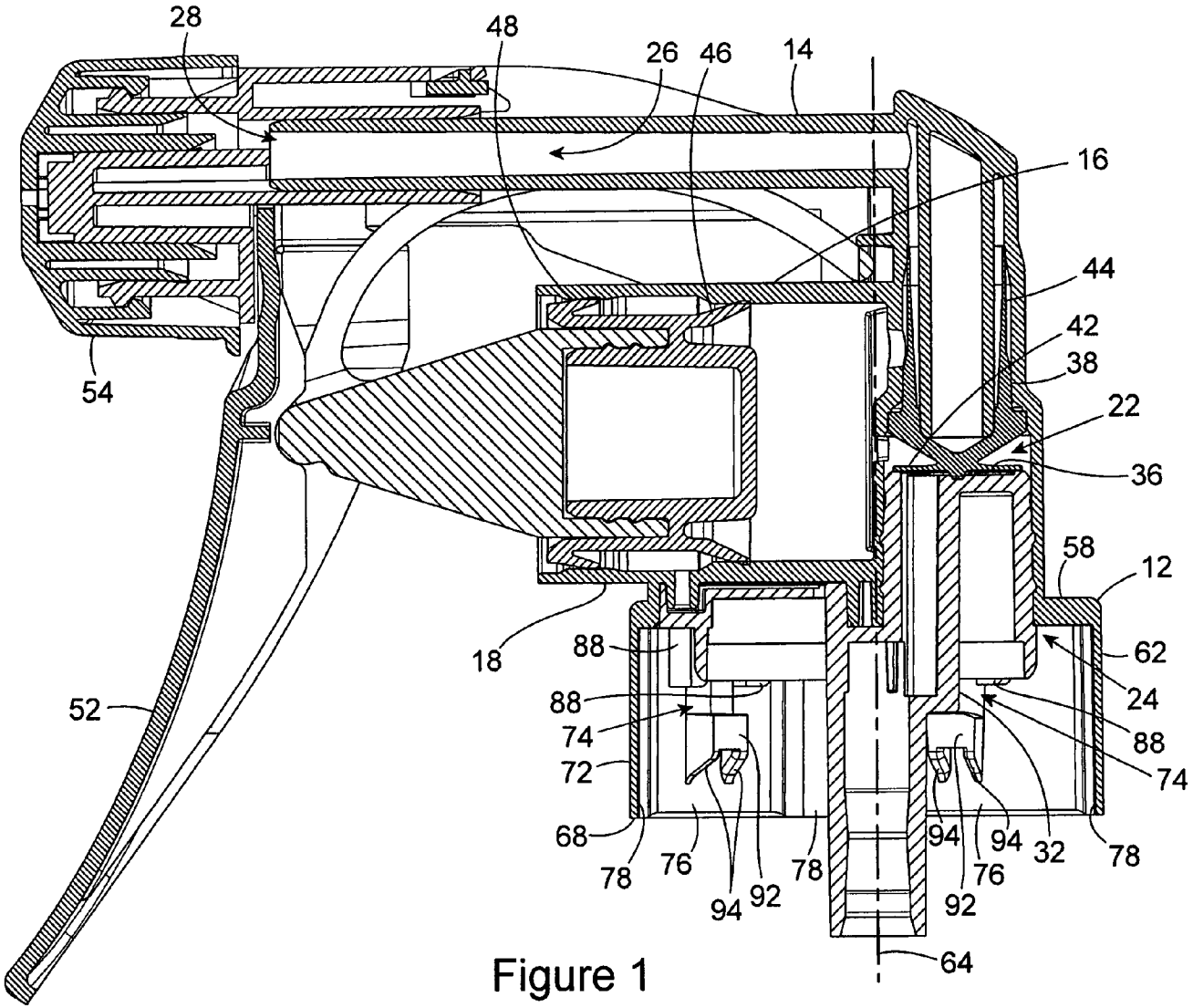
FIG. 1 is a side elevation view, in section, of a trigger sprayer employing the connector apparatus of the present invention.

FIG. 1 shows an example of a trigger sprayer construction employing the connector apparatus of the present invention. It should be understood that the trigger sprayer construction shown in FIG. 1 is only one example of a trigger sprayer that can employ the connector apparatus of the present invention. There are various other different designs of trigger sprayers that are equally well suited for use with the connector apparatus of the invention. Furthermore, the connector apparatus of the invention is shown in FIG. 1 as one, integral piece with the sprayer housing of the trigger sprayer. In the preferred embodiment of the invention, the connector apparatus is connected as a single piece with the sprayer housing. However, in alternate embodiments of the invention, the connector apparatus could be a separate piece from the trigger sprayer housing that is assembled to the trigger sprayer housing. Because the trigger sprayer shown in FIG. 1 is only one example of a trigger sprayer construction that can employ the connector apparatus of the invention, the trigger sprayer will be described only generally herein.

In the preferred embodiment of the connector apparatus shown, the connector apparatus includes a connector cap 12 that is formed in one piece with the sprayer housing 14 of the trigger sprayer. The sprayer housing 14 contains a cylindrical pump chamber 16, a cylindrical vent chamber 18, a liquid supply passage 22 that extends from a liquid inlet opening 24 in the sprayer housing to the pump chamber 16, and a liquid discharge passage 26 that extends from the pump chamber 16 to a liquid outlet opening 28 in the sprayer housing.

A dip tube connector 32 is inserted into the liquid inlet opening 24 of the sprayer housing. The dip tube connector 32 has a lower portion that connects a dip tube (not shown) with the sprayer housing 14. The top of the dip tube connector 32 has a surface 36 that functions as an input valve seat in the liquid supply passage 22.

A two piece valve assembly 38 is inserted into the sprayer housing 14 above the dip tube connector 32. The valve assembly 38 has a flexible disk valve 42 at its lower end that seats against the valve seat surface 36 of the dip tube connector 32. The disk valve 42 controls the flow of liquid through the dip tube 34 and the dip tube connector 32 to the pump chamber 16, and prevents the reverse flow of liquid. A flexible sleeve valve 44 projects upwardly from the valve assembly 38. The sleeve valve 44 controls the flow of liquid from the pump chamber 16 through the liquid discharge passage 26 to the liquid outlet opening 28, and prevents the reverse flow of liquid.

A pump piston 46 is mounted in the pump chamber 16 for reciprocating movements between charge and discharge positions of the pump piston in the pump chamber. When moved forwardly to the charge position shown in FIG. 1, the pump piston 46 draws liquid into the pump chamber 16. When moved rearwardly to the discharge position, the pump piston 46 pumps the liquid from the pump chamber 16.

A vent piston 48 is connected to the pump piston 46 for reciprocating movements with the pump piston. The vent piston 48 is mounted in the vent chamber 18 for reciprocating movements between vent open and vent closed positions. When the pump piston 46 is moved rearwardly in the pump chamber 16 toward the discharge position, the vent piston 48 is also moved in the rearward direction in the vent chamber 18 toward the vent open position. In the vent open position, the interior of the bottle connected to the trigger sprayer is vented through the vent chamber 18 to the exterior environment of the sprayer housing 14. When the pump piston 46 is moved forwardly in the pump chamber 16 toward the charge position, the vent piston 48 is also moved forwardly in the vent chamber to the vent closed position.

A coil spring (not shown) is positioned in the pump chamber 16 and engages against the pump piston 46. The spring biases the pump piston in the forward direction toward the charge position of the piston relative to the pump chamber 16. Thus, the spring also biases the vent piston 48 in the forward direction toward the vent closed position.

A trigger 52 is mounted on the sprayer housing 14 for pivoting movement of the trigger relative to the sprayer housing. The trigger 52 is operatively connected to the pump piston 46 and the vent piston 48. Movement of the trigger 52 on the sprayer housing 14 by the user's hand holding the trigger sprayer results in the reciprocating movements of the pump piston 46 and the vent piston 48 in the respective pump chamber 16 and vent chamber 18.

An indexing nozzle 54 is mounted on the sprayer housing 14 at the liquid outlet opening 28. The nozzle 54 can be turned on the sprayer housing to selectively prevent and permit liquid discharge from the sprayer housing. In addition, the indexing nozzle 54 can be rotated to various positions of the nozzle relative to the sprayer housing 14 where the spray pattern of liquid discharged from the sprayer housing is changed between a spray, stream, and foam discharge pattern.

The construction of the trigger sprayer set forth above is typical, and is only one example of the construction of the various known types of trigger sprayers. As stated earlier, the particular construction of the trigger sprayer described herein is intended to be illustrative only, and is not intended to limit the use of the novel connector apparatus of the invention to any one particular type of trigger sprayer construction.

The connector cap 12 of the connector apparatus is formed as one monolithic piece with the sprayer housing 14. The cap 12 has a circular top wall 58 and a cylindrical sidewall 62 having a center axis 64. The center axis 64 defines mutually perpendicular axial and radial directions relative to the connector cap 12. The cap side wall 62 extends axially downwardly from the peripheral edge of the cap top wall 58 to a circular bottom edge 68 of the side wall. The cap bottom edge 68 surrounds a bottom opening to the interior volume of the cap. The cap sidewall has a smooth, cylindrical exterior surface 72 that extends completely around the cap sidewall and is only interrupted by circumferentially spaced mold holes 74.

Each of the mold holes 74 are a result of the molding process employed in forming the connector cap 12. The mold holes 74 are not essential to the functioning of the connector apparatus of the invention. The cap sidewall 62 could be formed with the lug assemblies without the mold holes 74 and the functioning of the connector cap 12 would be the same.

Figure 5:
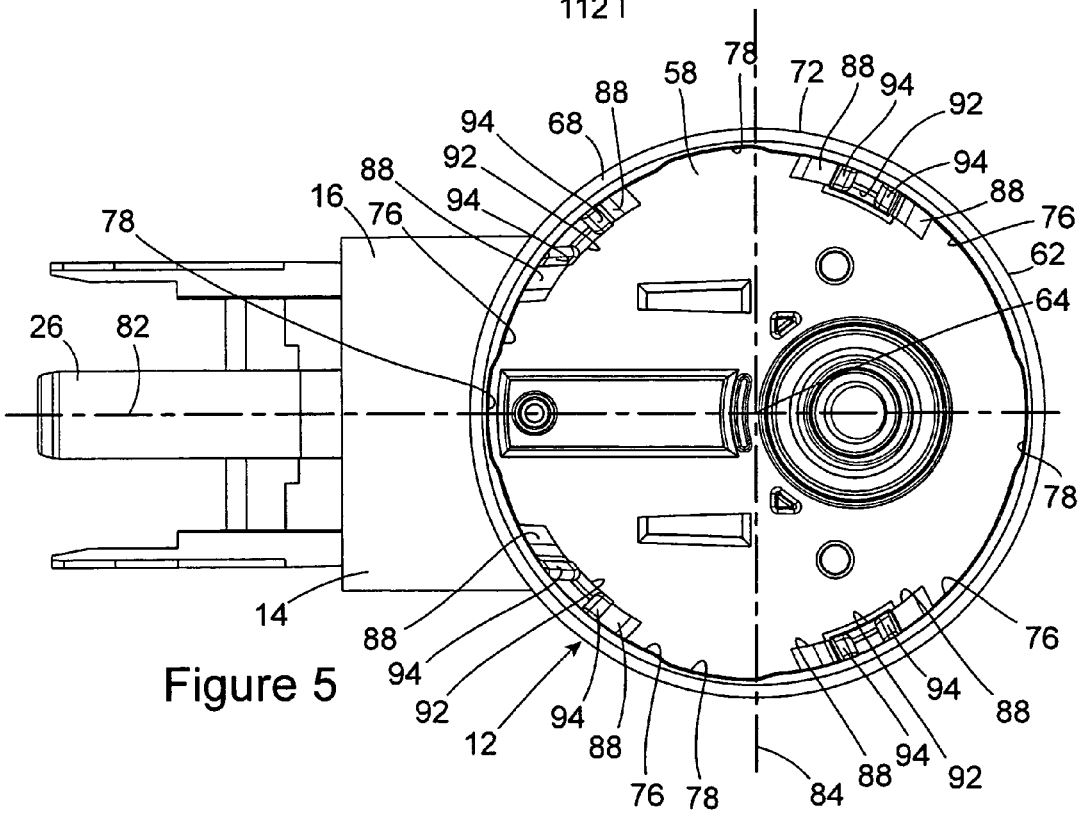
FIG. 5 is a bottom plan view of the trigger sprayer connector of FIG. 3.

The cap interior surface is cylindrical and is comprised of a plurality of thick areas 76 and a plurality of thin areas 78. The thick areas 76 and thin areas 78 alternate around the circumference of the sidewall interior surface. The sidewall thick areas 76 have a first thickness dimension between the cap exterior surface 72 and the cap interior surface at the thick areas 76. The sidewall thin areas 78 have a second thickness dimension between the cap exterior surface 72 and the cap interior surface at the thin areas 78. The first thickness dimension is larger than the second thickness dimension. The cap thick areas 76 and thin areas 78 each have general rectangular configurations. The thin areas 78 extend the entire axial length of the sidewall interior surface from the cap top wall 58 to the cap bottom edge 68. Likewise, the cap thick areas 76 extend the entire axial length of the cap interior surface from the cap top wall 58 to the cap bottom edge 68. As seen in FIG. 5, the positioning of the thin areas 78 is symmetric on opposite sides of a center plane 82 that bisects the cap and the sprayer housing 14. However, the positioning of the thin areas 78 is asymmetric on opposite sides of a perpendicular plane 84 that contains the cap center axis 64 and is perpendicular to the center plane 82. Because the cap sidewall thick areas 78 have a thickness dimension that is larger than the thickness dimension of the cap sidewall thin areas 78, the cap sidewall thin areas 78 are more flexible than the cap thick areas 76.

In the preferred embodiment of the invention, the thin areas 78 of the sidewall 62 are recessed into the interior surface of the sidewall. This provides the increased flexibility in the thin areas of the sidewall while presenting the more desirable appearance of the smooth exterior surface of the sidewall. Even with the thin areas 78 recessed into the sidewall interior surface, a majority of the sidewall circumference is made up of the thick areas 76 of the sidewall. Each thin area 78 of the sidewall interior surface occupies approximately $1/24^{th}$ of the total circumferential dimension of the sidewall interior surface. Thus, the sidewall 62 remains substantially rigid and supports the trigger sprayer firmly on the bottle neck.

Figure 3:
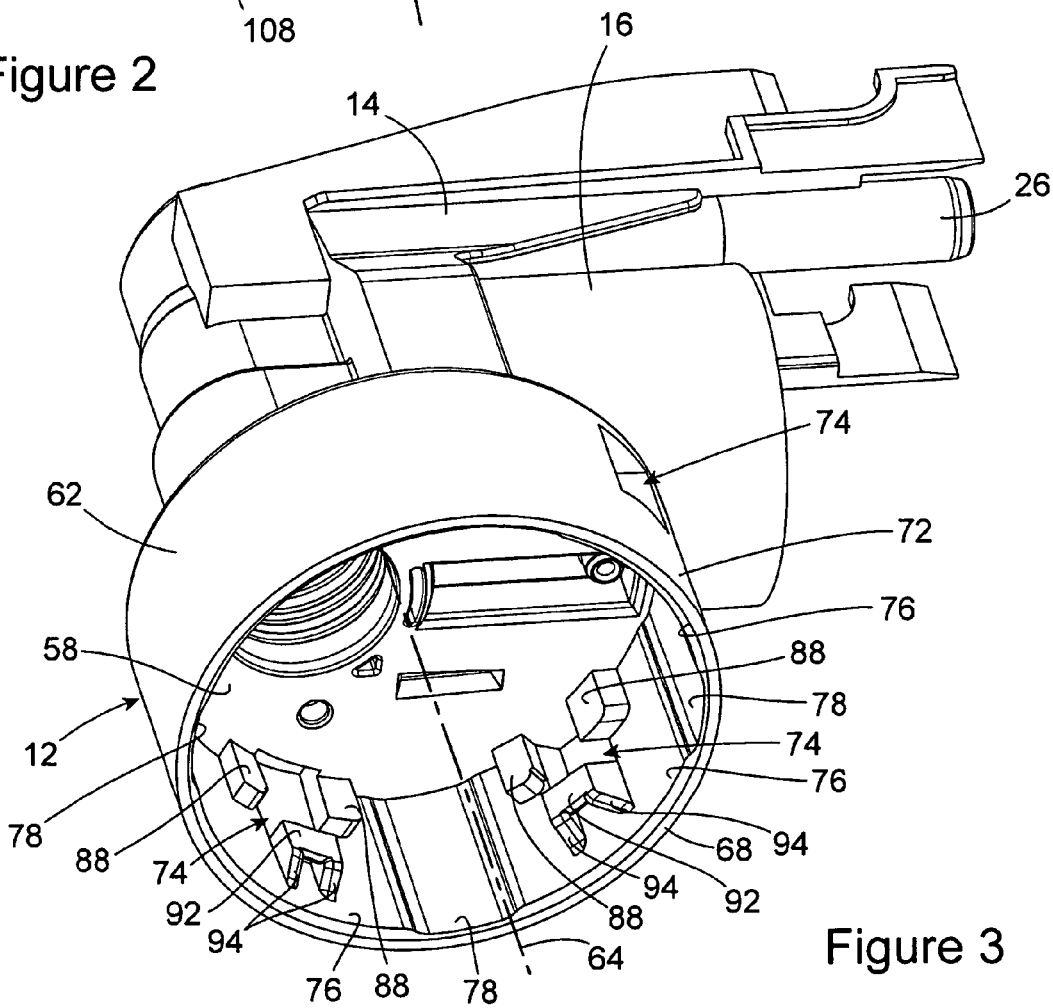
FIG. 3 is a bottom perspective view of the trigger sprayer connector of the invention.

Four lug assemblies are provided on the sidewall interior surface. The lug assemblies are each comprised of a pair of circumferentially spaced upper lugs 88, and a single lower lug 92 that is axially spaced from the upper lugs. As seen in FIG. 3, the upper lugs 88 of each lug assembly are positioned on opposite sides of a mold hole 74, and the lower lug 92 of each lug assembly is positioned directly below the mold hole. Each of the lower lugs 92 has cam surfaces 94 that angle radially outwardly as they extend axially downwardly. This tapered configuration of the lower lug cam surfaces 94 facilitates the attachment of the connector cap 12 on the container neck by snap fitting the cap on the neck, as will be explained.

As seen in FIG. 5, pairs of the lug assemblies are positioned on opposite sides of the center plane 82 and on opposite sides of the perpendicular plane 84. This positions the lug assemblies to securely hold the connector cap 12 to a bottle neck.

Figure 2:
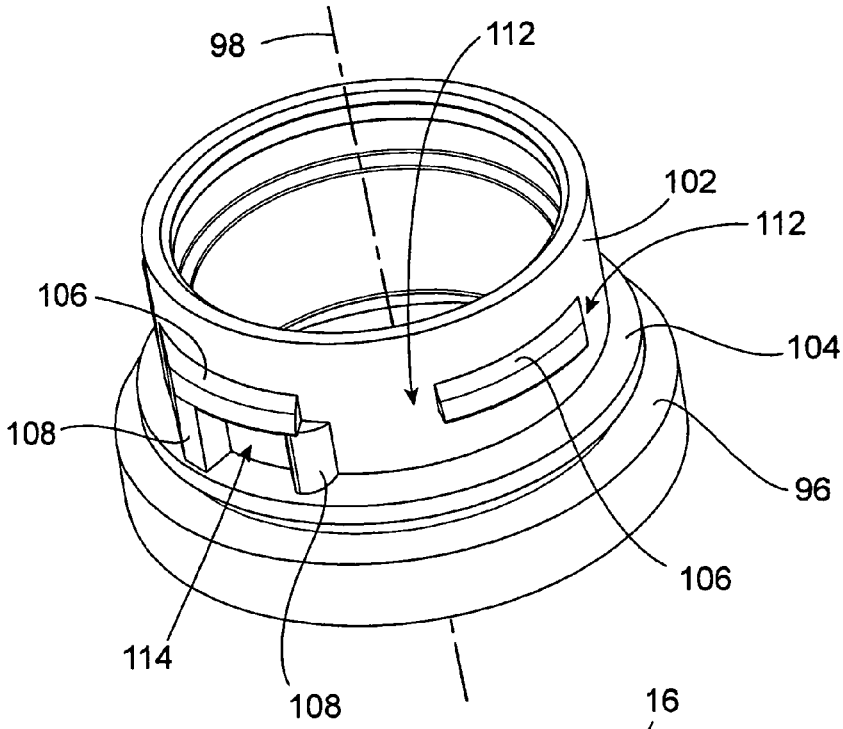
FIG. 2 is a top perspective view of a bottle neck that employs the connector apparatus of the invention.
Figure 4:
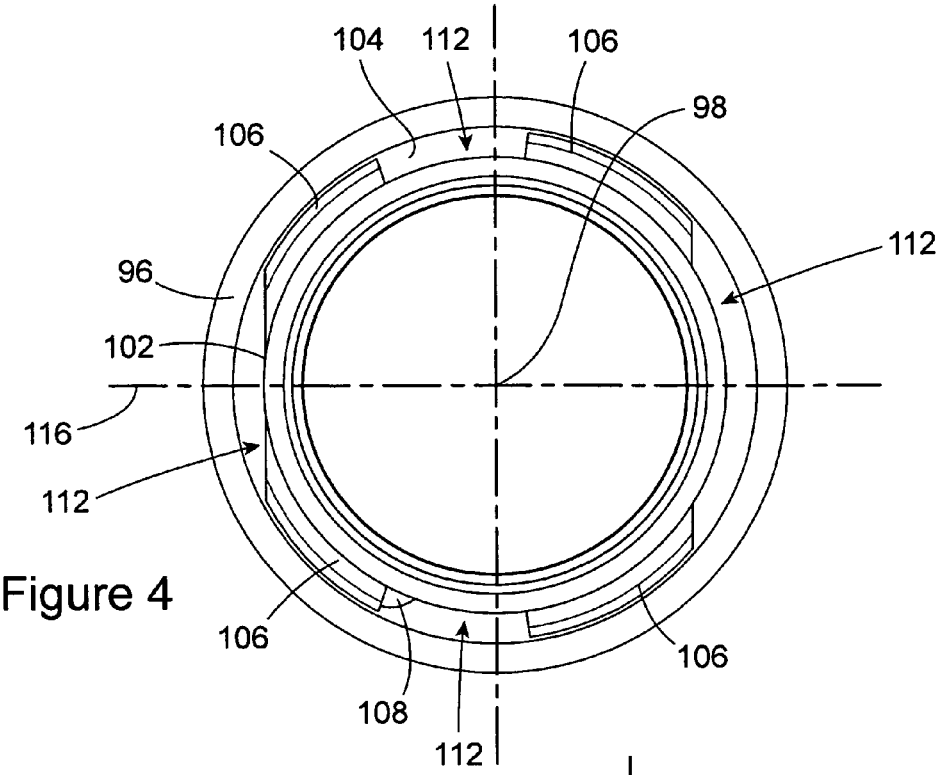
FIG. 4 is a top plan view of the bottle neck of FIG. 2.

Only the top of a bottle 96 designed for use with the connector cap 12 of the invention is shown in FIGS. 2 and 4. The bottle has an opening with a center axis 98 and a cylindrical neck 102 that extends around the opening. The bottle neck opening receives the dip tube 34 of the trigger sprayer when the connector cap 12 is attached to the bottle. An annular rim 104 extends radially outwardly from the bottom of the bottle neck 102. The annular rim 104 is dimensioned to engage the interior surface of the cap sidewall 62 when the cap 12 is attached to the bottle neck 102 to stabilize the trigger sprayer on the bottle.

Just above the annular rim 104, the exterior surface 106 of the bottle neck is cylindrical and smooth except for four separate arcuate ridges 106 and two pairs of axial ridges 108. The arcuate ridges 106 are circumferentially spaced around the bottle neck. The positions of the arcuate ridges 106 correspond to the circumferential spacing of the lug assemblies on the interior surface of the cap sidewall 62. An arcuate spacing is provided between each of the arcuate ridges 106. The arcuate spacing 112 between the adjacent arcuate ridges 106 is sufficiently large to enable the lower lugs 92 of the cap lug assemblies to pass through the spacing. Each of the arcuate ridges 106 has an axial width dimension that corresponds to the axial spacing between the lower lug 92 and the upper lugs 88 of each lug assembly. In alternate embodiments of the invention, the arcuate ridges 106 could be replaced by a single circular ridge that extends entirely around the circumference of the bottle neck 102.

Each of the axial ridges 108 projects radially outwardly from the bottle neck 102 to the same extent as the arcuate ridges 106. The axial ridges 108 extend axially from the opposite ends of two of the four arcuate ridges 106. The two arcuate ridges 106 are to the left in FIG. 3. The axial ridges 108 extend downwardly from the arcuate ridges 106 to the annular rim 104 around the bottle neck 102. The circumferential spacing 114 between the pairs of axial ridges 108 is dimensioned to receive one of the lower lugs 92 of the lug assemblies. As seen in FIG. 4, the positioning of the bottle neck arcuate ridges 106 and axial ridges 108 is symmetric on opposite sides of a center plane 116 of the bottle neck.

In the preferred embodiment of the invention, the connector cap 12 is attached to the bottle neck 102 by being pressed axially downwardly on the bottle neck without rotating the connector cap relative to the bottle neck. In attaching the connector cap 12 on the bottle neck 102, the trigger sprayer is positioned relative to the bottle so that the connector cap center plane 82 is co-planar with the bottle neck center plane 116. This aligns the lower lugs 92 of the lug assemblies with the arcuate ridges 106 on the bottle neck 102. Continued axial downward movement of the connector cap 12 over the bottle neck 102 causes the cam surfaces 94 of the lower lugs 92 to engage with and slide over the arcuate ridges 106. This causes the arcuate ridges 106 to push radially outwardly on the lower lugs 92, and resiliently flexes the connector cap side wall 62 at the thin areas 78. This allows the lower lugs 92 to move radially outwardly relative to the arcuate ridges 106 as they are pushed axially downwardly over the ridges. When the lower lugs 92 pass over the arcuate ridges 106, they snap into position against the undersides of the arcuate ridges 106. In addition, two of the lower lugs 92 snap into the spacing 114 between the pairs of axial ridges 108. With the lower lugs 92 positioned beneath the arcuate ridges 106, the upper lugs 88 engage against the top of the arcuate ridges 106. This securely holds the connector cap 12 on the bottle neck 102 and prevents axial movement of the cap relative to the bottle neck. Furthermore, the engagement of two of the lower lugs 92 in the spacing 114 between the pairs of axial ridges 108 prevents the connector cap 12 from being rotated relative to the bottle neck 102. Still further, the engagement of the bottle neck annular rim 104 with the interior surface of cap side wall 62 securely holds the cap 10 on the container neck 102 and prevents any relative movement or rocking of the cap on the container neck. In this manner, the container cap 12 of the invention is attached to the bottle neck 102 by only being pressed axially downwardly onto the bottle neck, and without rotating the connector cap 12 relative to the bottle neck 102.

Although the present invention has been described above by reference to a specific embodiment, it should be understood that modifications and variations of the invention may be constructed without departing from the scope of the invention defined in the following claims.

The invention claimed is:

1. A connector apparatus for connecting a trigger sprayer to a bottle, the apparatus comprising:

a trigger sprayer housing;

a cylindrical sidewall on the sprayer housing, the sidewall having a center axis that defines mutually perpendicular axial and radial directions relative to the sidewall, the sidewall having opposite exterior and interior surfaces, and the sidewall interior surface having a circumference that extends around the center axis;

a plurality of attachment lug assemblies on the sidewall interior surface, each attachment lug assembly projecting radially inwardly from the sidewall interior surface toward the center axis;

a plurality of thick areas on the sidewall interior surface with each thick area having a first thickness dimension between the sidewall exterior surface and the sidewall interior surface at the thick area;

a plurality of thin areas on the sidewall interior surface with each thin area having a second thickness dimension between the sidewall exterior surface and the sidewall interior surface at the thin area, the second thickness dimension being smaller than the first thickness dimension, the thin areas alternating with the thick areas around the sidewall interior surface circumference;

the plurality of attachment lug assemblies being on only the thick areas of the sidewall interior surface and not on the thin areas of the sidewall interior surface; and, each attachment lug assembly including at least two lugs that project radially inwardly from the sidewall interior surface and are spaced axially from each other.

2. The apparatus of claim 1, further comprising:

the trigger sprayer housing being connected as one piece with the sidewall.

3. The apparatus of claim 1, further comprising:

the thin areas of the sidewall interior surface being recessed into the sidewall interior surface between thick areas of the sidewall interior surface.

4. The apparatus of claim 1, further comprising:

the sidewall having a circular bottom edge that surrounds a bottom opening into the sidewall; and, each thin area of the sidewall interior surface intersects the bottom edge.

5. The apparatus of claim 1, further comprising:

each of the thin areas of the sidewall interior surface having circumferential dimension that is at least $1/24^{th}$ of the sidewall interior surface circumference.

6. The apparatus of claim 1, further comprising:

each of the thin areas of the sidewall interior surface having an equally dimensioned rectangular configuration.

7. The apparatus of claim 1, further comprising:

the sidewall exterior surface being a smooth cylindrical surface that extends completely around the sidewall.

8. The apparatus of claim 1, further comprising:

the sidewall interior surface having a configuration that is symmetric on opposite sides of a center plane that bisects the sidewall and is parallel with the sidewall center axis.

9. The apparatus of claim 8, further comprising:

the center plane bisecting the trigger sprayer housing.

10. A connector apparatus for connecting a trigger sprayer to a bottle, the apparatus comprising:

a trigger sprayer housing;

a cylindrical sidewall on the sprayer housing, the sidewall having a center axis that defines mutually perpendicular axial and radial directions relative to the sidewall, the sidewall having opposite exterior and interior surfaces, and the sidewall interior surface having a circumference that extends around the center axis;

a plurality of attachment lug assemblies on the sidewall interior surface, each attachment lug assembly projecting radially inwardly from the sidewall interior surface toward the center axis;

a plurality of thick areas on the sidewall interior surface with each thick area having a first thickness dimension between the sidewall exterior surface and the sidewall interior surface at the thick area;

a plurality of thin areas on the sidewall interior surface with each thin area having a second thickness dimension between the sidewall exterior surface and the sidewall interior surface at the thin area, the second thickness dimension being smaller than the first thickness dimension, the thin areas alternating with the thick areas around the sidewall interior surface circumference; and, each of the thin areas of the sidewall interior surface having an axial dimension that extends completely across the sidewall interior surface and a circumferential dimension that extends partially around the sidewall interior surface circumference.

11. A connector apparatus for connecting a trigger sprayer to a bottle, the apparatus comprising:

a trigger sprayer housing;

a cylindrical sidewall on the sprayer housing, the sidewall having a center axis that defines mutually perpendicular axial and radial directions relative to the sidewall, the sidewall having opposite exterior and interior surfaces, and the sidewall interior surface having a circumference that extends around the center axis;

a plurality of attachment lug assemblies on the sidewall interior surface, each attachment lug assembly projecting radially inwardly from the sidewall interior surface toward the center axis;

a plurality of thick areas on the sidewall interior surface with each thick area having a first thickness dimension between the sidewall exterior surface and the sidewall interior surface at the thick area;

a plurality of thin areas on the sidewall interior surface with each thin area having a second thickness dimension between the sidewall exterior surface and the sidewall interior surface at the thin area, the second thickness dimension being smaller than the first thickness dimension, the thin areas alternating with the thick areas around the sidewall interior surface circumference;

the sidewall interior surface having a configuration that is symmetric on opposite sides of a center plane that bisects the sidewall and is parallel with the sidewall center axis; and the sidewall interior surface configuration being asymmetric on opposite sides of a perpendicular plane that is parallel to the center axis and perpendicular to the center plane.

12. The apparatus of claim 11, further comprising:

a majority of a total area of the thin areas on the sidewall interior surface being positioned on one side of the perpendicular plane.

13. A connector apparatus for connecting a trigger sprayer to a bottle, the apparatus comprising:

a trigger sprayer housing;

a cylindrical sidewall on the trigger sprayer housing, the cylindrical sidewall having a center axis that defines mutually perpendicular axial and radial directions relative to the sidewall, the sidewall having opposite exterior and interior surfaces, the sidewall interior surface having a circumference that extends around the center axis;

a plurality of attachment lug assemblies on the sidewall interior surface, each attachment lug assembly projecting radially inwardly from the sidewall interior surface;

a plurality of thin areas on the sidewall interior surface, each thin area being recessed into the sidewall interior surface and thereby reducing a thickness of the sidewall at each thin area, the thin areas alternating with the attachment lug assemblies around the sidewall interior surface circumference;

the attachment lug assemblies projecting from the sidewall interior surface at positions between the thin areas on the sidewall interior surface and not from the thin areas on the sidewall interior surface; and, each attachment lug assembly included at least a pair of axially spaced lugs.

14. A connector apparatus for connecting a trigger sprayer to a bottle, the apparatus comprising;

a trigger sprayer housing;

a cylindrical sidewall on the trigger sprayer housing, the cylindrical sidewall having a center axis that defines mutually perpendicular axial and radial directions relative to the sidewall, the sidewall having opposite exterior and interior surfaces, the sidewall interior surface having a circumference that extends around the center axis;

a plurality of attachment lug assemblies on the sidewall interior surface, each attachment lug assembly projecting radially inwardly from the sidewall interior surface;

a plurality of thin areas on the sidewall interior surface, each thin area being recessed into the sidewall interior surface and thereby reducing a thickness of the sidewall at each thin area, the thin areas alternating with the attachment lug assemblies around the sidewall interior surface circumference; and, each of the thin areas of the sidewall interior surface having an axial dimension that extends completely across the sidewall interior surface and a circumferential dimension that extends partially around the sidewall interior surface circumference.

15. The apparatus of claim 14 further comprising:

each of the thin areas of the sidewall interior surface having an equally dimensioned rectangular configuration.

16. A connector apparatus for connecting a trigger sprayer to a bottle, the apparatus comprising:

a trigger sprayer housing;

a cylindrical sidewall connected in one piece with the trigger sprayer housing, the cylindrical sidewall having a center axis that defines mutually perpendicular axial and radial directions relative to the sidewall, the sidewall having opposite exterior and interior surfaces, the sidewall interior surface having a circumference that extends around the center axis;

a plurality of attachment lug assemblies on the sidewall interior surface, each attachment lug assembly having a pair of axially spaced lugs that project radially inwardly from the sidewall interior surface toward the center axis, the plurality of attachment lug assemblies being spacially arranged around the sidewall interior surface with at least a pair of attachment lug assemblies being positioned opposite each other on the sidewall interior surface;

the cylindrical sidewall interior surface having a plurality of thick areas spacially arranged around the sidewall with each thick area having a first thickness dimension between the sidewall exterior surface and the sidewall interior surface at each thick area of the sidewall interior surface;

the cylindrical sidewall interior surface having a plurality of thin areas spacially arranged around the sidewall between the thick areas of the sidewall with each thin area having a second thickness dimension between the sidewall exterior surface and the sidewall interior surface at each thin area of the sidewall interior surface, the second thickness dimension being smaller than the first thickness dimension; and, each attachment lug assembly projecting from one of the thick areas of the sidewall interior surface between a pair of thin areas of the sidewall interior surface.

17. The apparatus of claim 16, further comprising:

each thin area of the sidewall interior surface being recessed into the sidewall interior surface between a pair of thick areas of the sidewall interior surface.

18. The apparatus of claim 17, further comprising:

the cylindrical sidewall exterior surface being a smooth cylindrical surface.

19. The apparatus of claim 16, further comprising:

the sidewall having a circular bottom edge that surrounds a bottom opening into the sidewall; and, each thin area of the sidewall interior surface intersects the bottom edge.

20. The apparatus of claim 16, further comprising:

each of the thin areas of the sidewall interior surface having an axial dimension that extends completely across the sidewall interior surface and a circumferential dimension that extends partially around the sidewall interior surface circumference.

* * * * *